US006383084B1

(12) United States Patent
McEachen et al.

(10) Patent No.: US 6,383,084 B1
(45) Date of Patent: May 7, 2002

(54) COLLAPSIBLE PLAY STRUCTURE

(75) Inventors: Peter C. McEachen, Macedonia; Shawn D. Heipp, Middleburg Heights, both of OH (US)

(73) Assignee: The Little Tikes Company, Hudson, OH (US)

( * ) Notice: Subject to any disclaimer, the term of this patent is extended or adjusted under 35 U.S.C. 154(b) by 0 days.

(21) Appl. No.: 09/591,431

(22) Filed: Jun. 9, 2000

(51) Int. Cl.[7] ..... A63G 21/02
(52) U.S. Cl. ..... 472/116; 482/35
(58) Field of Search ..... 472/116, 117, 472/3; 482/35, 36, 37, 38

(56) References Cited

U.S. PATENT DOCUMENTS

| | | | | |
|---|---|---|---|---|
| 3,231,942 A | | 2/1966 | O'Brien | 52/70 |
| 3,548,552 A | | 12/1970 | McBride | 52/70 |
| 3,561,757 A | | 2/1971 | Schillig | 272/60 |
| 3,969,871 A | | 7/1976 | Ewers | 52/721 |
| 4,112,635 A | | 9/1978 | Rylander | 52/69 |
| 4,941,658 A | | 7/1990 | Poo | 272/56.5 |
| D311,941 S | | 11/1990 | Thomson et al. | D21/114 |
| D333,328 S | | 2/1993 | Aker et al. | D21/114 |
| 5,437,573 A | | 8/1995 | Rodriguez-Ferre | 472/116 |
| 5,580,316 A | | 12/1996 | Hill et al. | 472/116 |
| 5,842,926 A | * | 12/1998 | Rodriguez-Ferre | 472/116 |
| 5,938,566 A | * | 8/1999 | Rodriguez-Ferre | 482/35 |

* cited by examiner

*Primary Examiner*—Kien T. Nguyen
(74) *Attorney, Agent, or Firm*—Piper Marbury Rudnick & Wolfe

(57) ABSTRACT

A foldable climber comprises a plurality of walls coupled to each other by a plurality of hinges, each wall being substantially perpendicular a support surface when the climber is in an assembled position. At least one platform is removably connected to at least two of the walls to stabilize the structure when in the assembled position. When the structure is in the collapsed position, the walls fold into a substantially flat configuration and define regions in which the platform can be stored.

22 Claims, 11 Drawing Sheets

COLLAPSIBLE PLAY STRUCTURE

TECHNICAL FIELD

This invention relates generally to children's play structures. More particularly, this invention relates to a children's play structure that can be easily assembled, collapsed and stored and transported by an individual.

BACKGROUND OF THE INVENTION

Play structures for young children are well known in the toy industry. In particular, there are a number of play structures currently available that are intended for use by children of ages between about two and five years. These structures typically have various features that allow children to climb the walls and platforms on the structure. Several such structures include slides or other items that increase the children's overall level of enjoyment.

In addition to the climbers being enjoyable for small children, a significant feature of some of these structures is the ability to store the climber in a relatively compact space when the structure is not in use. It is also important that the climbers can be assembled and disassembled with relative ease. For example, U.S. Pat. No. 5,437,573, issued to Rodriguesferre discloses a structure that includes several walls which are connected to each other by several corner panels. A horizontal platform and a slide are connected to at least one of the walls, and a round bar is used to stabilize at least two of the walls. A major disadvantage of this structure, however, is that many parts are required for assembly of the structure. U.S. Pat. No. 5,580,316 issued to Hill et al. discloses a foldable play structure with a plurality of walls and a slide. The walls are hingedly connected to each other, and the hinged regions include stop surfaces and projections to latch the walls when in the assembled position. There are no horizontal components that can both add to the overall stability of the structure and increase the enjoyment of the users by having an additional object to climb on.

It is therefore desirable to have a foldable play structure that cures the above-mentioned deficiencies while still optimizing the user's level of enjoyment.

SUMMARY OF THE INVENTION

This invention provides for a collapsible play structure comprising a plurality of walls coupled to each other by a plurality of hinges. In an assembled position, at least one platform is removably connected to at least two of the walls, thereby bracing the walls and increasing the overall stability of the structure. When the structure is collapsed, the walls fold along the hinges such that the walls fold into a substantially flat configuration. In this collapsed position, the overall thickness of the structure is substantially similar to the combined thicknesses of each of the walls.

In a preferred embodiment, when the structure is in a collapsed configuration, regions exist inside the structure for the storage of the platform, slide and possibly other components. Preferably, a latching mechanism is coupled to at least two of the walls, locking the walls in place when the structure is in the collapsed position. Also preferably, at least one wheel is located on a lower portion of one of the walls, permitting an individual to handle the structure and roll it back to storage.

One technical advantage of the collapsible structure of the present invention is that it requires little time to assemble.

A further advantage of the invention is that the play structure requires no additional tools to assemble or disassemble.

Another advantage of the invention is that all of the components of the play structure can be easily stored in one self-contained unit when the structure is in a collapsed position.

Another advantage of the invention is its ease in transportation when the structure is in the collapsed position.

Another advantage of the invention's foldable play structure is that, while requiring a relatively few number of components for the user to assemble, it has superior stability when in the assembled position in order to maintain adequate safety levels for children.

Further advantages and features of the present invention will be apparent from the following specification and claims, once considered in connection with the accompanying drawings illustrating the preferred embodiment of the present invention. Like characters identify like parts in the drawings.

DETAILED DESCRIPTION OF THE INVENTION

Figure 1:
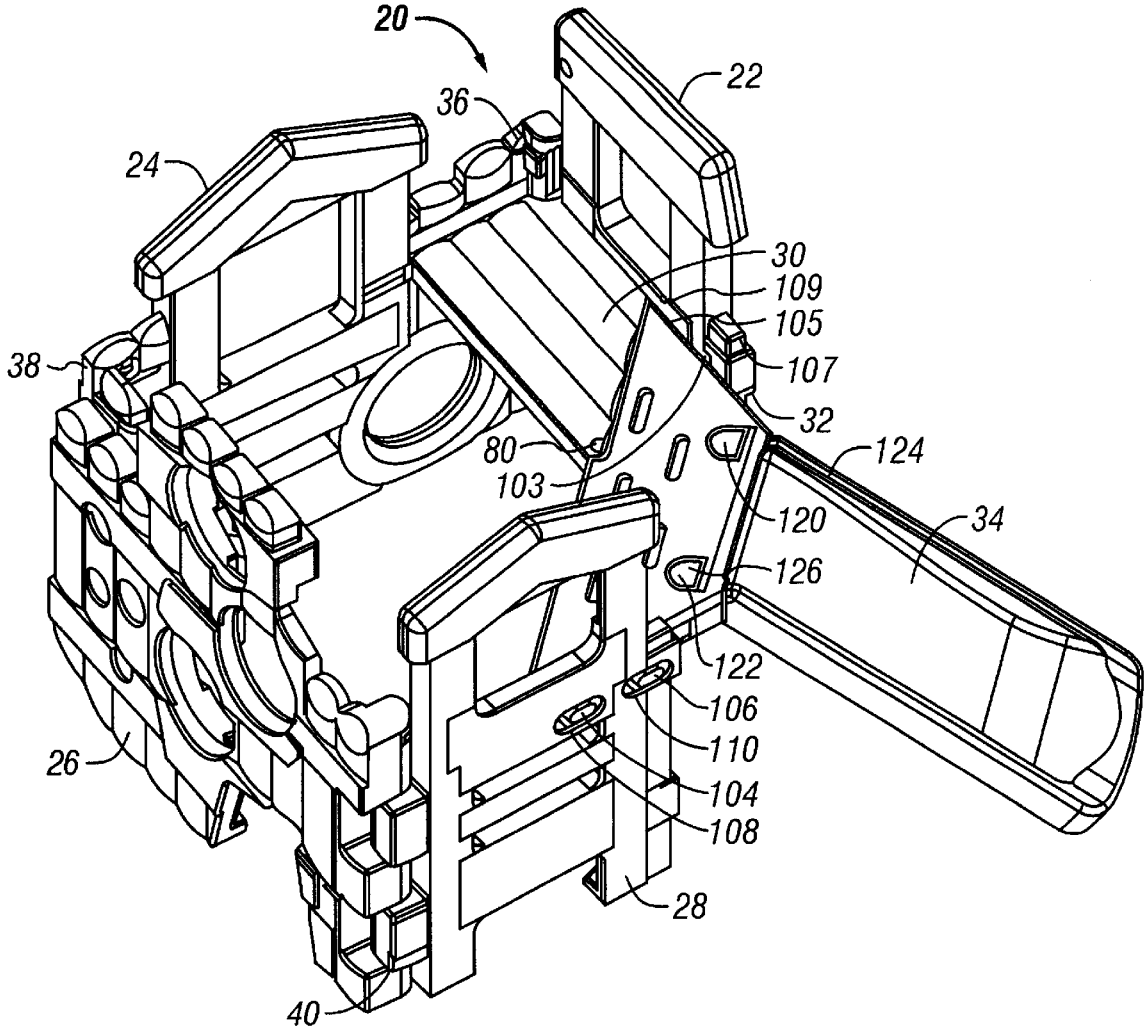
FIG. 1 is an isometric view of a collapsible play structure in an assembled position.

As shown in FIG. 1, a play structure, shown generally at 20, comprises first, second, third, and fourth walls 22, 24, 26, and 28 respectively. The first wall 22 is rotatably connected to the second wall 24 via a first hinge 36. The second wall 24 is rotatably connected to the third wall 26 via a second hinge 38. The third wall 26 is rotatably connected to the fourth wall 28 via a third hinge 40. When the structure 20 is in the assembled position, each of the walls 22, 24, 26 and 28 will be substantially perpendicular to the support surface (such as the ground) and will be positioned at an angle to the immediately adjacent walls. In the assembled position, each of first and second rigid platforms 30 and 32 operates in cooperation with each other to stabilize the first and fourth walls 22 and 28 and to prevent any of walls 22, 24, 26 and 28 from rotating. The first platform 30 is removably connected to the first and second walls 22 and 24, while the second platform 32 is removably connected to walls 22 and 28.

Figure 2:
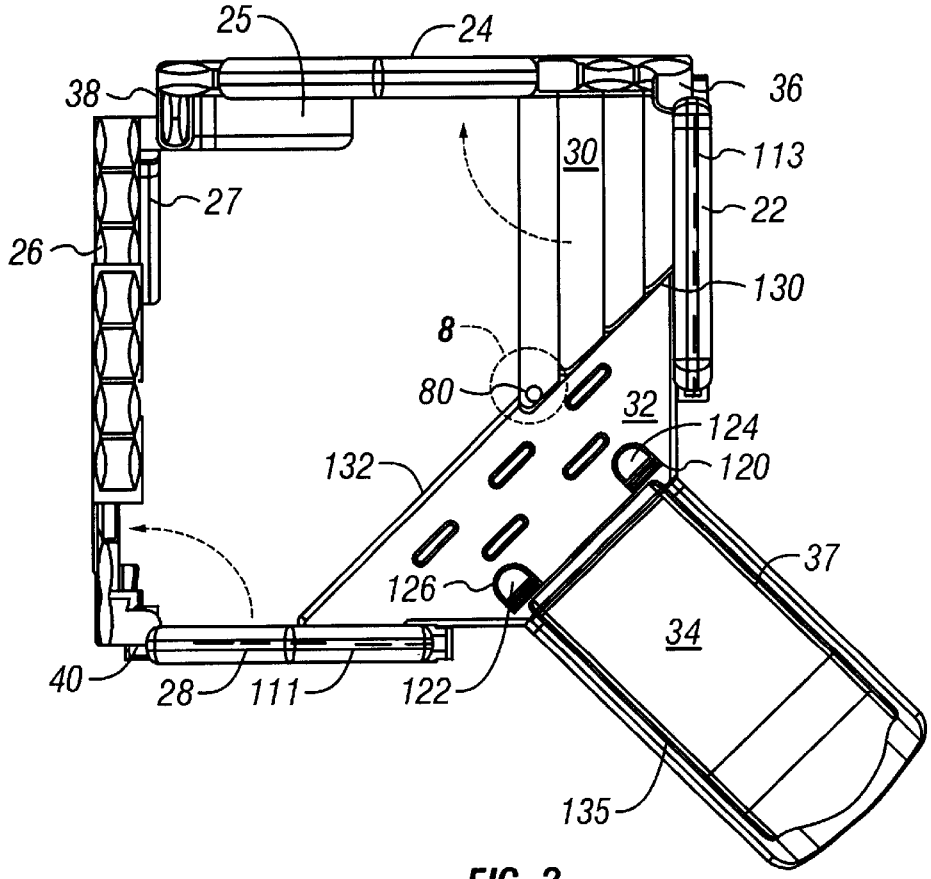
FIG. 2 is a top end view of the play structure of FIG. 1.
Figure 3:
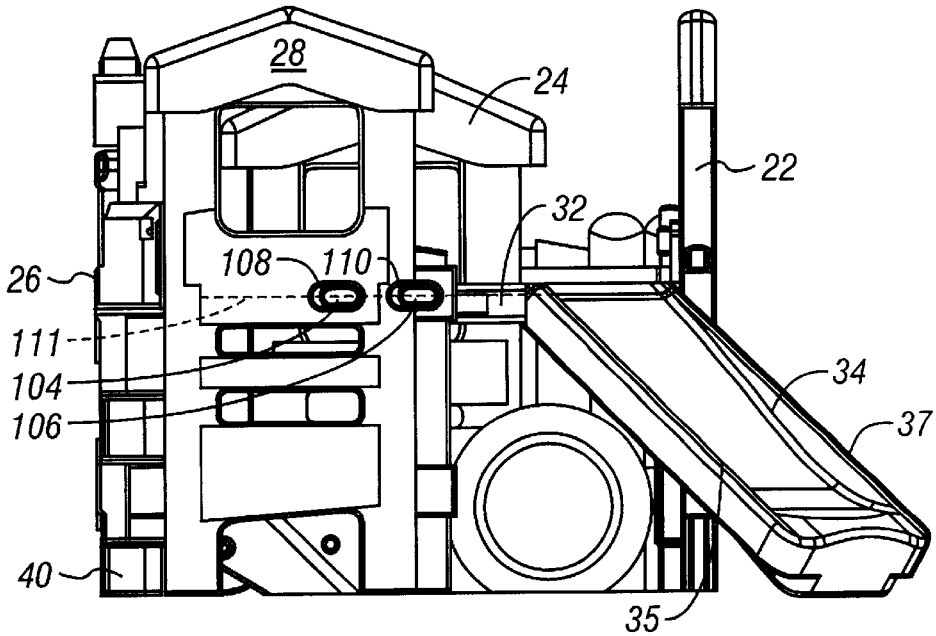
FIG. 3 is a front end view of the structure of FIG. 1.
Figure 10:
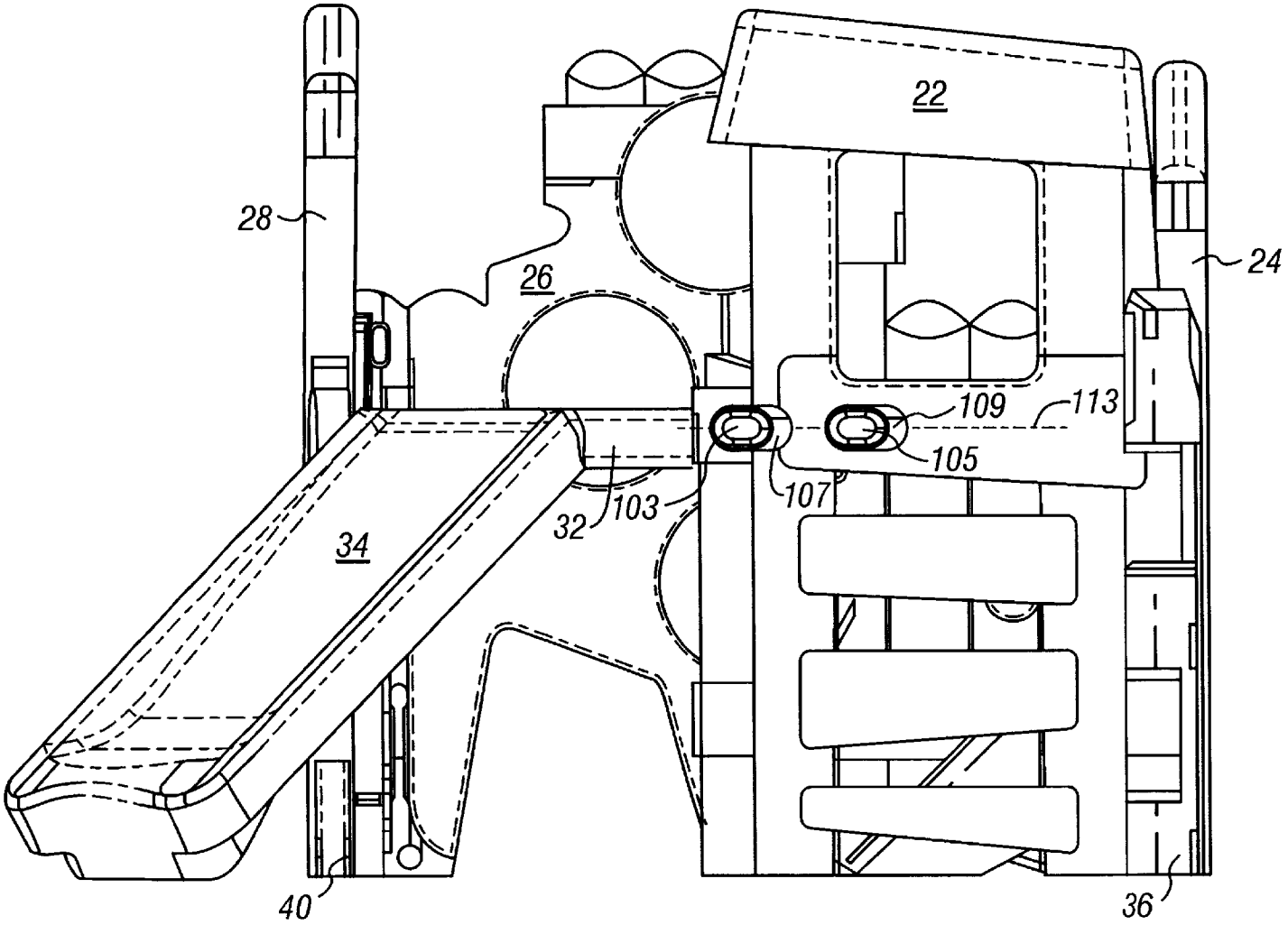
FIG. 10 is a side view of the assembled structure of FIG. 1.

FIGS. 2 and 3 show different views of the play structure 10 when in the fully assembled position. As can be seen in FIG. 3, the second platform 32 is removably connected to the fourth wall 28 by a plurality of projections 104 and 106. The projections 104 and 106, which are preferably formed as one piece with the second platform 32, project into holes 108 and 110 that are located in the fourth wall 28. As shown in FIG. 10, similar projections 103 and 105 and holes 107 and 109 in the first wall 22 cooperate to further secure the second platform 32. The projections 104 and 106 and corresponding holes 108 an 110 serve as two points which define a line 111, while projections 103 and 105 and corresponding holes 107 and 109 serve as two additional attachment points which define a second line 113 formed at a substantial angle to the first (vertical) wall 22 and the fourth (vertical) wall 28. By being connected to the rest of the structure along both line 111 and line 113, the structure rigidifies the hinged components, preventing movement around the hinges 36, 38 and 40.

Figure 6:
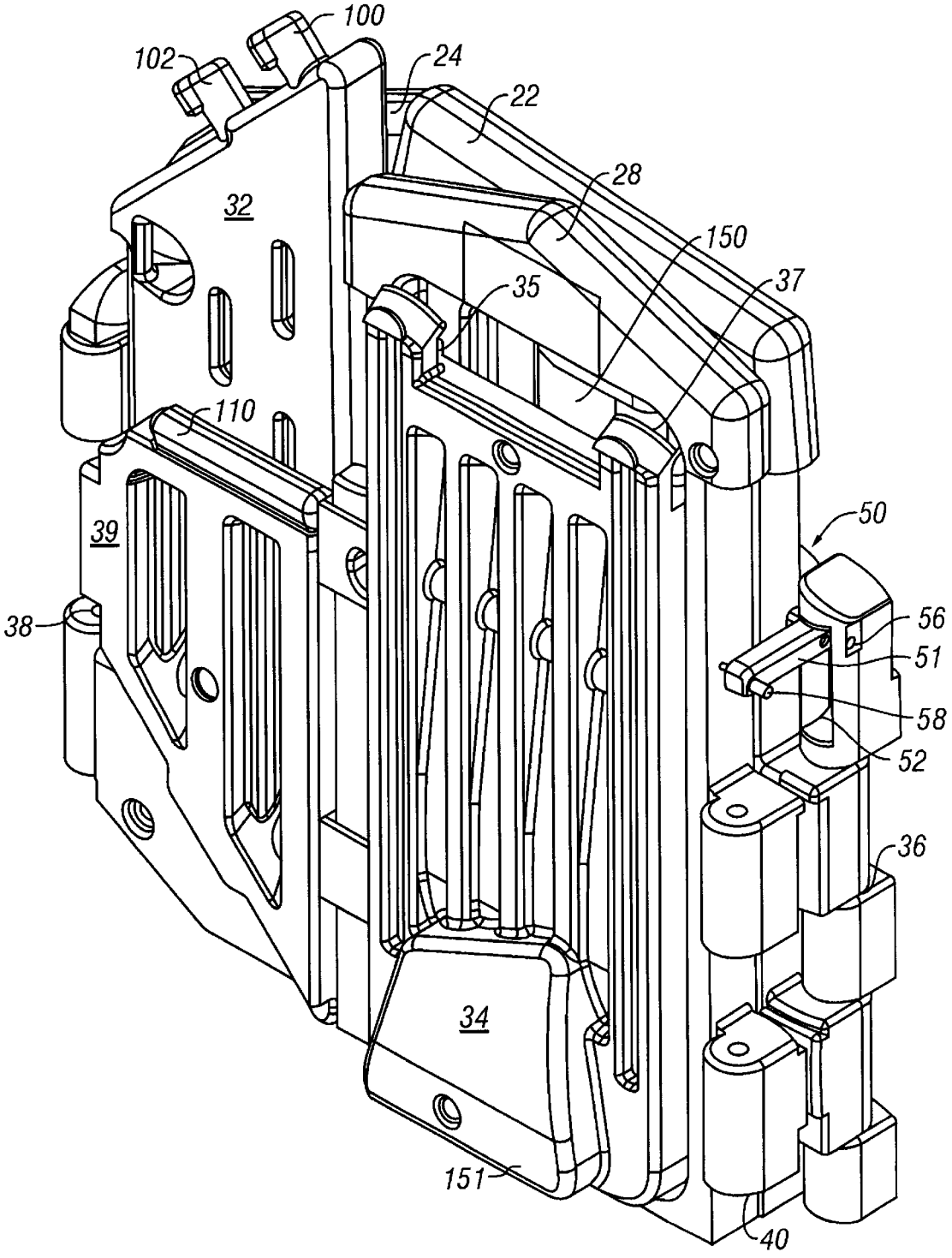
FIG. 6 is an isometric view of the play structure of FIG. 4 with one side panel removed from the structure and showing the stored components inside.
Figure 7:
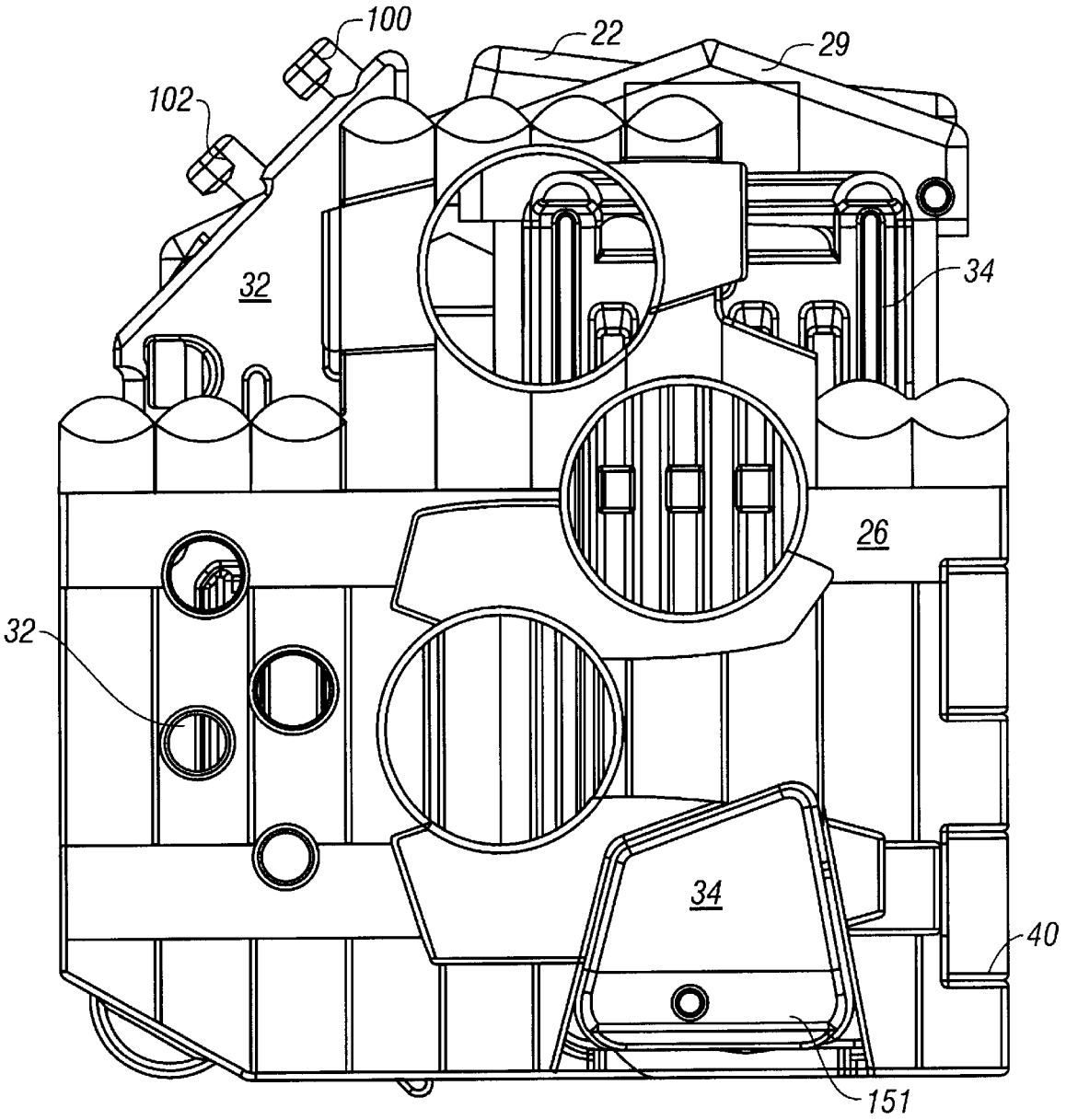
FIG. 7 is a side view of the structure of FIG. 4.

The first platform 30 is removably connected to the second wall 24 by an abutment member 110, best shown in FIG. 6. The abutment member 110 fits into a slot (not shown) in the second wall 24. A similar abutment member is used to couple the first platform 30 to the first wall 22. According to one embodiment of the invention, the platforms 30 and 32 are secured to the first, second, and fourth walls 22, 24, and 28.

Figure 8:
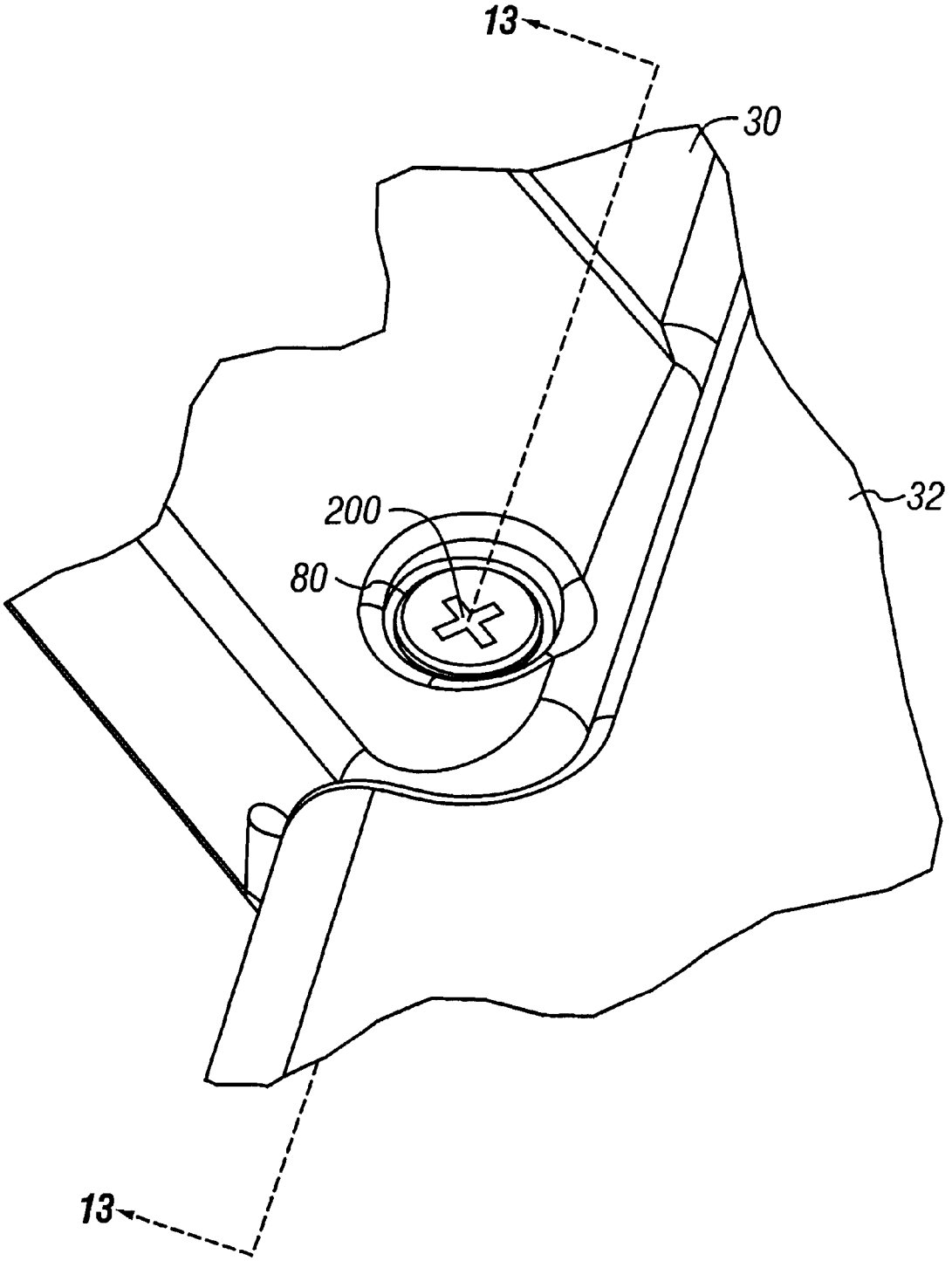
FIG. 8 is a sectional view of the pin connector taken along lines 8—8 of FIG. 2.
Figure 13:
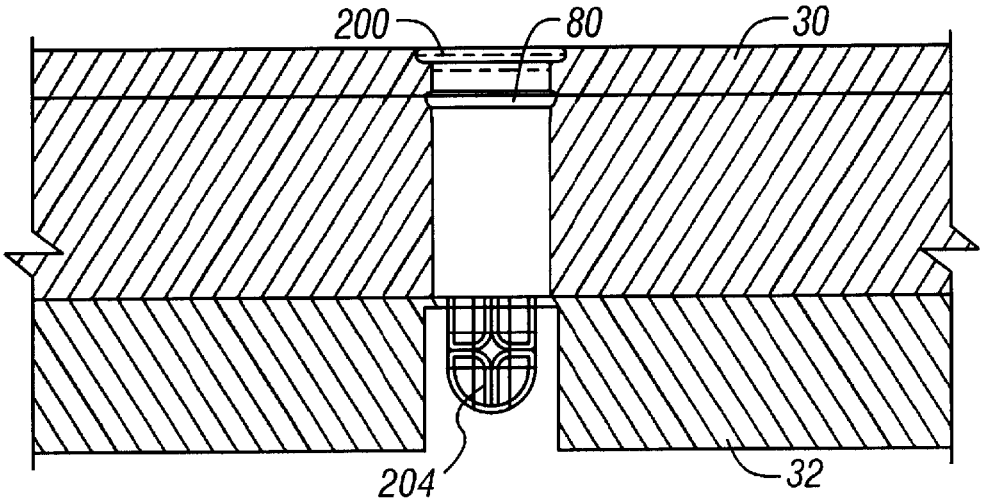
FIG. 13 is a sectional view of the pin connector taken substantially along line 13—13 of FIG. 8.
Figure 14:
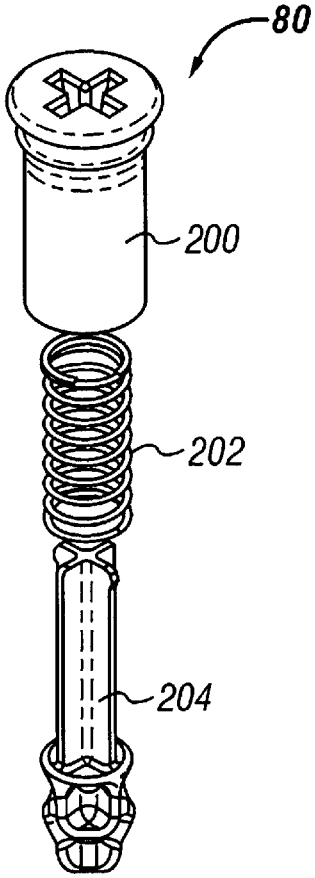
FIG. 14 is an exploded view of the pin connector of FIG. 13.

The first and second platforms 30 and 32 are connected to each other by a pin connector 80, shown in detail at FIGS. 8 and 13–14. The pin connector 80 comprises a top portion 200, a spring 202 and a lower portion 204. According to one embodiment of the invention, the pin connector 80 is fixedly located within the first platform 30 when the two platforms 30 and 32 are separated from each other. When the structure 20 is assembled, the user pushes the first platform onto the second platform 32, and the lower portion 204 of the pin connector 80 locks into a hole on the second platform 32. To unlock the connector 80 the lower portion 204 is pushed up from underneath the platforms 30 and 32, causing the platforms 30 and 32 to disengage.

The platforms 30 and 32 may also include additional mating surfaces to ensure a better fit between them. As shown in FIG. 2, for example, an angled edge 130 of the first platform extends over one edge 132 of the second platform 32.

Figure 11:
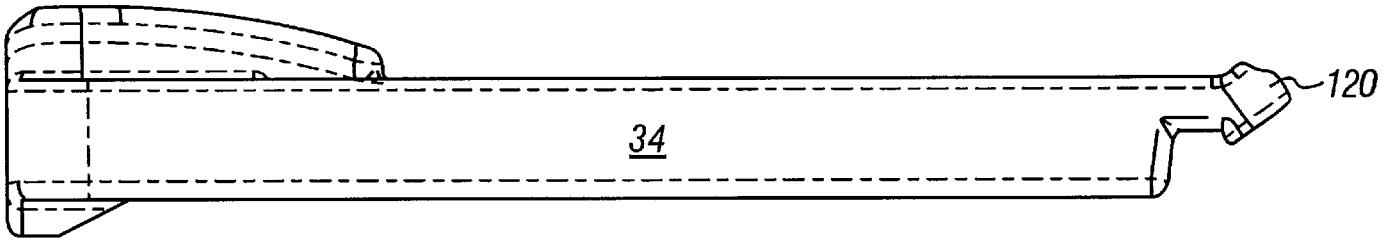
FIG. 11 is a side view of the slide when removed from the structure.
Figure 12:
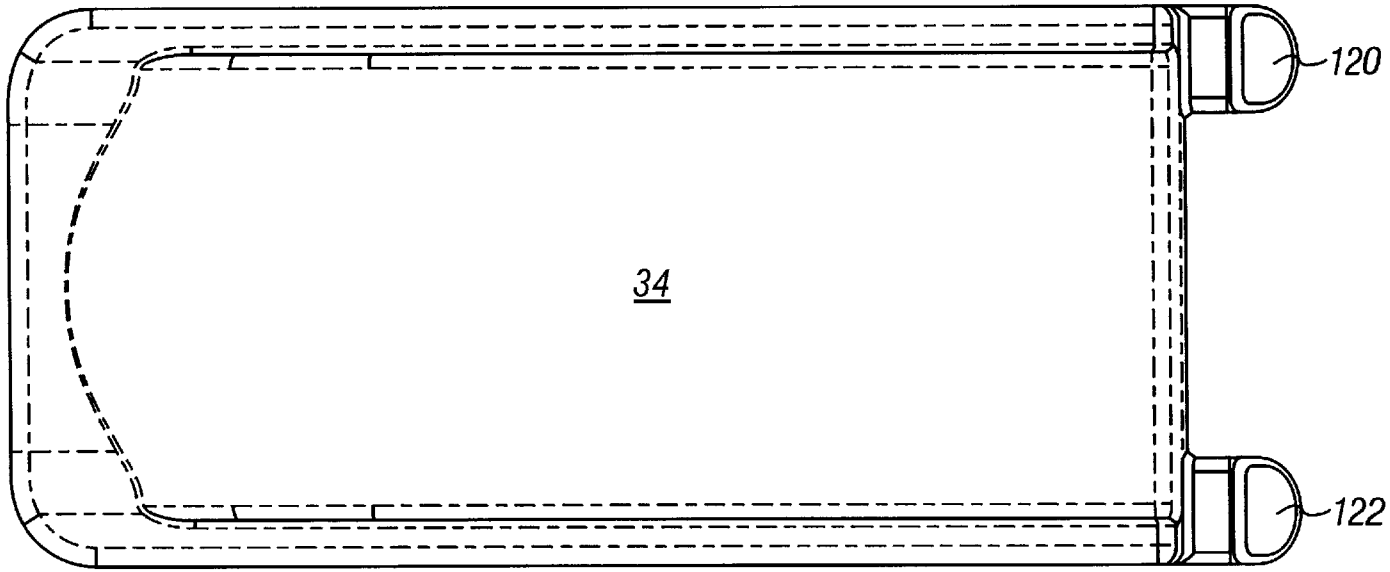
FIG. 12 is a top view of the slide of FIG. 11.

A slide 34 is removably connected to the second platform 32 via projections 120 and 122 that fit into holes 124 and 126 of the second platform 32. The projections 120 and 122, best shown in FIGS. 11–12, project upward at the top of the slide 34 in order to securely latch the slide 34 onto platform 32, although other shapes are also possible for the projections 120 and 122. The two platforms 30 and 32 stabilize the walls 22, 24, 26, and 28 preventing unnecessary and undesired motion of the structure 20. The arrangement eliminates the need for hinge stops or hinge locks in the structure.

Complete stabilization by a platform could also be achieved in a structure having three walls. In a structure having five or more walls, the walls to which the platform(s) attach will be locked into place with respect to each other, so long as the platform(s) are in a plane which is at an angle to each attached wall and that the attached walls are at an angle to each other.

When it is desired to collapse and store the structure 20, the platforms 30 and 32 and the slide 34 are removed from the structure. The walls 22, 24, 26 and 28 fold at the hinges 36, 38, and 40 to create a more compact structure. In particular, the third and fourth walls 26 and 28 rotate via hinge 40 such that the two walls 26 and 28 rest directly against each other. Similarly, the first and second walls 22 and 24 rotate about hinge 36 so that those two walls 22 and 24 rest against each other. The second and third walls 24 and 26, which are intermediate to the first and fourth walls 22 and 28, then rotate inwardly about hinge 38 in a direction such that the first and fourth walls 22 and 28 will come into contact with each other, while the second and third walls 24 and 26 will be outside of the first and fourth walls 22 and 28. The fully collapsed structure is shown on FIGS. 4–7 and 9. The hinges 36, 38, and 40 are formed in one embodiment of the invention by a plurality of pins (not shown) that insert through alternating wall crenellations to connect the respective walls to each other. It is possible, however, to use other types of devices to create the hinged joints.

Before folding the third and fourth walls 26 and 28 about the hinge 40, the slide 34 is stored inside a depression 150 of the fourth wall 28, shown in FIG. 6. A protruding shape 151 of the slide 34 also fits into a cutout of the third wall 26. Sides 35 and 37 of the slide 34 project away from the slide surface such that they guide the slide 34 into the correct position relative to the depression 150. It is also possible to have the depression include grooves for a better fit with the slide 34. The placement of the slide 34 against the fourth wall 28 allows for easy storage of the slide 34 when the structure 20 is in the collapsed position.

Figure 4:
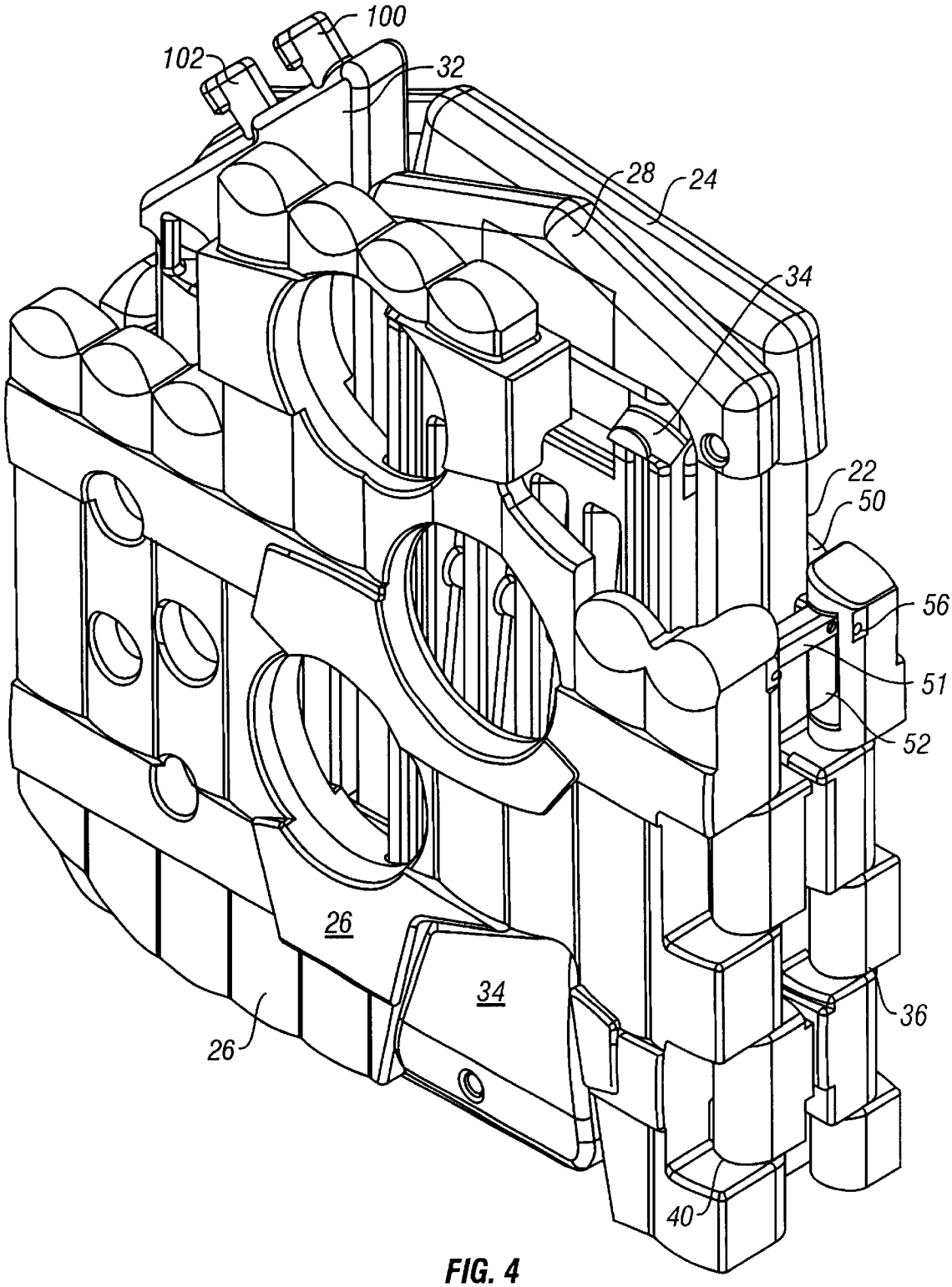
FIG. 4 is an isometric view of the foldable play structure when in a collapsed position.
Figure 5:
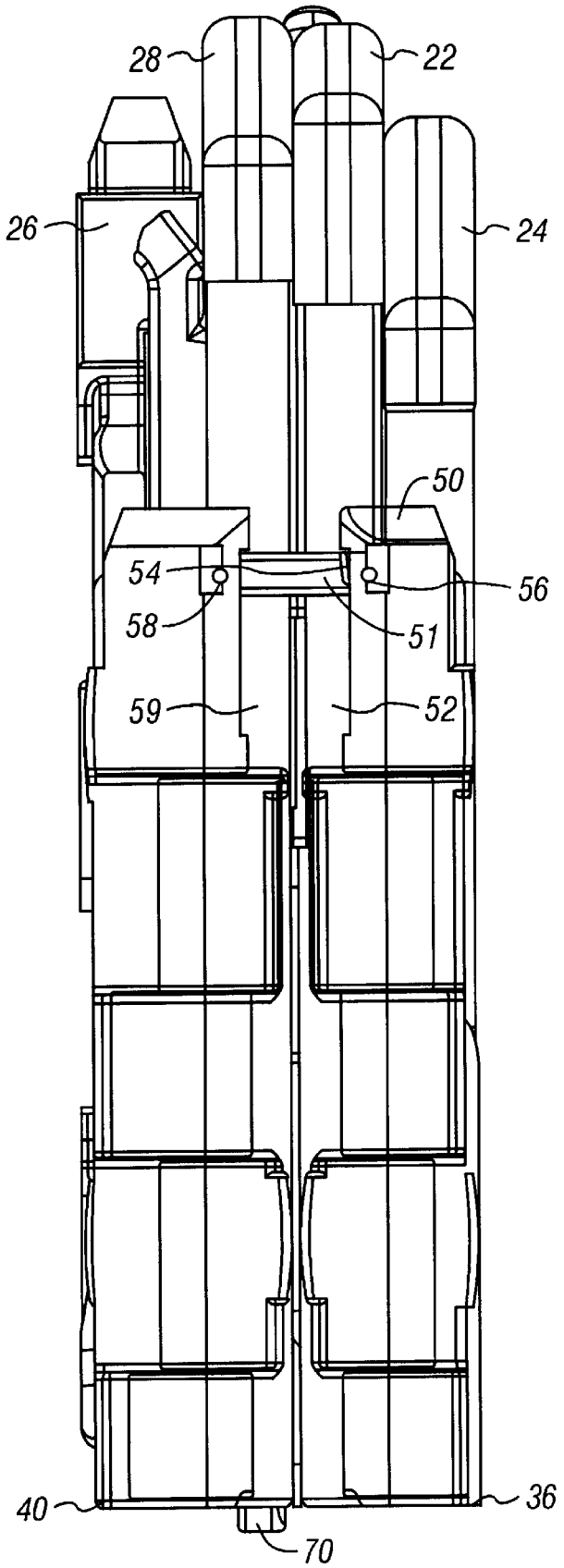
FIG. 5 is a front end view of the structure of FIG. 4.

Once the second and third walls 24 and 26 are rotated such that the walls 24 and 26 come into contact with each other, a latch, shown generally at 50 in FIGS. 4–6, is used to maintain the structure 20 in a fully collapsed position. The latching mechanism 50 comprises a lever arm 51 and pins 56 and 58. In one embodiment of the invention, the lever arm 51 is rotatably connected by pin 58 to the third wall 26 and removably connected by pin 56 to the second wall 24. Both of the pins 56 and 58 are fixedly attached to their respective walls 24 and 26. The free end of the lever arm 51 includes a slot 54 that is slightly wider than the width of pin 56. To successfully lock the second and third walls 24 and 26 to each other, the lever arm 51 is rotated counter clockwise and is snap-fit to the pin 56 in order to unlock the latching mechanism 50, a downward force is applied to the lever arm 51, causing the lever to move in a clockwise direction. Depressions 52 and 59 (FIG. 5) are formed within the second and third walls 24 and 26 in order to allow for the easy movement and storage of the lever arm 51 when in different positions.

When in the collapsed position, the overall thickness of the structure 20 is substantially reduced. According to one embodiment of the invention, the thickness of the collapsed structure is only about one-fourth the thickness of the assembled structure and is substantially equal to the combined thicknesses of each of the walls 22, 24, 26 and 28. It is possible to vary the thickness ratio of the assembled and collapsed structure 20, however, by adjusting the lengths or thicknesses of the walls 22, 24, 26, and 28. Advantageously, the intermediate, hinged walls 24 and 26 form the outer sides of the structure when the structure 20 is in the collapsed position. The end walls 22 and 28, which are hinged only on one side, are folded inwardly to occupy space interiorly of the intermediate walls 24 and 26. This cages the end walls 22 and 28 when the structure is in the collapsed position.

When the structure 20 is in the collapsed position, the arrangement of the walls 22, 24, 26 and 28 combine to create an open space in which the first and second platforms 30 and 32 can be stored. The storage of the first and second platforms is shown in FIGS. 4 through 7. According to one embodiment of the invention, the first platform 30 is stored against the third wall 26, with the angled portion of the first platform facing downward. The second platform 32 is then placed against the second wall 24. In order to facilitate the storage of the platforms 30 and 32, the second and third walls 24 and 26 preferably include additional projections 25 and 27 located near the bottom of the walls 24 and 26. These projections are shown in FIG. 2. Preferably the projections 25 and 27 project inwardly enough so that the two platforms 30 and 32 rest on top of the projections 25 and 27 when the structure 20 is in the collapsed position. This prevents the platforms 30 and 32 from sliding through the structure 20 when the structure 20 is in the collapsed position.

Figure 9:
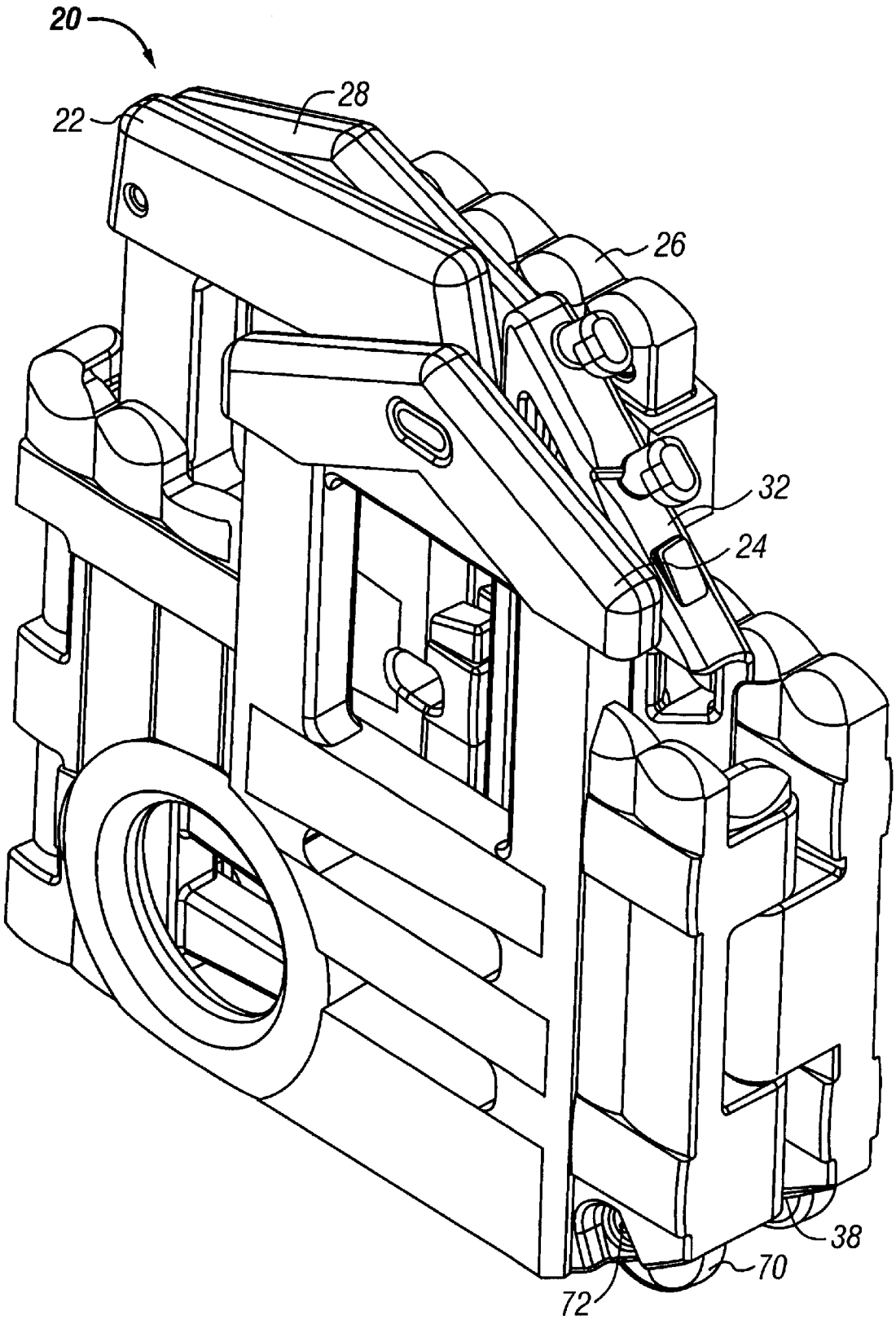
FIG. 9 is a reverse isometric view of the structure of FIG. 4.

As is shown in FIG. 9, the structure 20 includes a wheel 70 to facilitate in the movement of the structure 20 when in the collapsed position. According to one embodiment of the invention, the wheel 70 is located at a lower corner of the second wall 24. The wheel 70 is coupled to the wall 24 by a pin 72. According to one embodiment of the invention, the wheel 70 is coupled to the wall 24 such that the wheel 70 can only rotate about one axis. It is possible, however, to couple the wheel 70 to the wall 24 to allow for multiple directions of rotation. When the structure is in the collapsed position, the user simply lifts the end of the structure 20 opposite the wheel 70, putting the majority of the weight on the wheel 70. The user is then able to push or drag the entire structure 20 with a reduced amount of effort.

According to one embodiment of the invention, the structure 20 comprises plastic material. Preferably the material is lightweight such that an average adult can move the structure when it is in the collapsed position. It is also important, however, for the material to be strong enough to support the weight of one or more children at a time.

While several preferred embodiments have been shown and described in this application, it is understood that changes and modifications can be made to the invention without departing from the invention's broader aspects. For example, different forms of hinges, abutments and projections can be used in order to attach the walls, platforms, or slide to other components. Additionally, different forms of hinges, latches, connectors or coupling devices can also be used throughout the structure. Furthermore, the shape and color of the individual walls, platforms or slide can also be adjusted in order to enhance the aesthetic appeal of the structure. Finally, the structure can also be made of a variety of different materials in order to increase the overall strength of the structure or to reduce the cost thereof. Therefore the present invention is not limited to the described and illustrated embodiment but only by the scope and spirit of the independent and dependent claims.

What is claimed is:

1. A foldable climber capable of being in an assembled position on a support surface and in a collapsed position, comprising:

a plurality of walls coupled to each other by a plurality of hinges in both the assembled and collapsed position, each wall being substantially perpendicular to the support surface when the climber is in the assembled position;

a first platform positioned at an angle to, removably connected to, and bracing at least two of the walls, the platform securing the position of two of the walls when the climber is in the fully assembled position, wherein the first platform mateably engages at least two of the walls; and a second platform removably connected to the first platform, the second platform capable of mateably engaging at least one wall, wherein the first and second platforms secure the position of each of the walls with respect to each other.

2. The climber of claim 1, wherein the first and second platforms are shaped such that, when in the assembled position, the first platform rests flush against the second platform and two of the walls, and the second platform rests flush against two of the walls, defining and reinforcing the positions of the walls relative to the adjacent walls.

3. The climber of claim 1, further comprising a slide having a first end removably connected to the first platform and a second end that contacts the ground.

4. The climber of claim 1, wherein the climber comprises four walls.

5. The climber of claim 1, wherein the walls each have thicknesses, the walls folding about the hinges such that the climber folds into a configuration wherein the thickness of the climber in the collapsed position is substantially the same as the sum of the wall thicknesses.

6. The climber of claim 1, further comprising a wheel coupled to the bottom of one of the walls such that the climber may be rolled away when the climber is in the collapsed position.

7. The climber of claim 6, wherein the wheel is located proximate the corner of one of the walls.

8. The climber of claim 7, wherein an axle of the wheel is fixed to said one of the walls.

9. The climber of claim 1, further comprising a locking mechanism having a member rotatably connected to the side of one of the walls, the member swinging into and out of engagement with a bar coupled to another one of the walls.

10. The climber of claim 9, wherein the bar is located within a recess within another one of the walls when the climber is in the assembled position.

11. A collapsible play structure erectable to an assembled position and collapsible to a collapsed position, comprising a plurality of walls including first and second end walls and at least two intermediate walls, each intermediate wall hinged to two adjacent walls around respective axes spaced from each other, each end wall hinged to a respective one of the intermediate walls around an axis; and first and second ones of said intermediate walls forming external sides of the play structure in the collapsed condition, a latching member connecting together first ends of the first and second ones of the intermediate walls when the play structure is in the collapsed condition.

12. The structure of claim 11, wherein second ends of the first and second ones of the intermediate walls, which second ends are opposed to said first ends thereof, are hinged together.

13. The structure of claim 11, wherein the latching member comprises a latch rotatably attached to the first one of the intermediate walls and removably attached to the second one of the intermediate walls.

14. The structure of claim 13, further comprising a wheel coupled to the lower portion of one of the first ends of the intermediate walls.

15. The collapsible play structure of claim 11, wherein said end walls fold inwardly such that the end walls are disposed interiorly of said first and second ones of said intermediate walls when the structure is in the collapsed condition.

16. A play structure having assembled and collapsed positions, comprising:

a plurality of hinged walls coupled to each other;

at least one panel removably connected to at least one of the walls, wherein the walls, when the structure is in the collapsed position, include therebetween a region for the placement of the panel; and a wheel coupled to the lower portion of one of the walls.

17. The structure of claim 16, wherein the panel comprises a horizontal platform removably coupled to at least one of the walls, the platform located generally perpendicular to the walls when the structure is in the assembled position.

18. The structure of claim 17, further comprising a plurality of panels stored in said region when the structure is in the collapsed position, wherein one of the panels comprises a slide removably coupled to the horizontal platform when the structure is in the assembled position, and wherein the walls, when the structure is in the collapsed position, includes a region for placement of the slide.

19. The structure of claim 16, further comprising a plurality of panels stored in said region when said structure is in the collapsed position, wherein the panels include two platforms, the first platform removably connected to at least two of the walls and the second platform removably connected to the first platform and a least one of the walls when the structure is in the assembled position.

20. The structure of claim 19, wherein the first and second platforms are shaped such that, when in the assembled position, the first platform rests flush against the second platform and two of the walls, and the second platform rests flush against two of the walls, defining and reinforcing the positions of the walls relative to the adjacent walls.

21. A foldable climber capable of being in an assembled position on a support surface and in a collapsed position, comprising:

a plurality of walls coupled to each other by a plurality of hinges in both the assembled and collapsed position, each wall being substantially perpendicular to the support surface when the climber is in the assembled position;

a first platform positioned at an angle to, removably connected to, and bracing at least two of the walls, the platform securing the position of two of the walls when the climber is in the fully assembled position; and a locking mechanism having a member rotatably connected to the side of one of the walls, the member swinging into and out of engagement with a bar coupled to another one of the walls.

22. The climber of claim 21, wherein the bar is located within a recess within another one of the walls when the climber is in the assembled position.

* * * * *